US007762096B2

(12) United States Patent
Fuchs

(10) Patent No.: US 7,762,096 B2
(45) Date of Patent: Jul. 27, 2010

(54) TEMPERATURE CONTROL VEST HAVING VISIBLE ICE SHEETS COMPOSED OF REFRIGERANT CUBES

(76) Inventor: Mark D. Fuchs, 3403 W. Riviera Ct., Mequon, WI (US) 53092

( * ) Notice: Subject to any disclaimer, the term of this patent is extended or adjusted under 35 U.S.C. 154(b) by 501 days.

(21) Appl. No.: 11/639,552

(22) Filed: Dec. 15, 2006

(65) Prior Publication Data

US 2008/0141696 A1 Jun. 19, 2008

(51) Int. Cl.
*F25D 23/12* (2006.01)

(52) U.S. Cl. ..... 62/259.3

(58) Field of Classification Search ..... 62/259.3; 2/102

See application file for complete search history.

(56) References Cited

U.S. PATENT DOCUMENTS 1,485,392 A 3/1924 Halek
4,033,354 A 7/1977 De Rosa
4,601,067 A 7/1986 Buonassissi
4,856,294 A 8/1989 Scaringe et al.
4,908,248 A 3/1990 Nakashima et al.
5,072,455 A * 12/1991 St. Ours ..... 2/81
5,146,625 A * 9/1992 Steele et al. ..... 2/102
5,305,471 A * 4/1994 Steele et al. ..... 2/102
5,606,746 A 3/1997 Shelton et al.
5,692,238 A * 12/1997 Watson, Jr. ..... 2/102
5,852,828 A * 12/1998 Foster ..... 2/102
2005/0056048 A1* 3/2005 Fuchs ..... 62/457.7

* cited by examiner

*Primary Examiner*—Cheryl J Tyler
*Assistant Examiner*—Lakiya Rogers
(74) *Attorney, Agent, or Firm*—Absolute Technology Law Group, LLC

(57) ABSTRACT

A temperature control vest for use in providing cooling for workers subject to extreme temperature work environments. The temperature control vest includes chest-covering pieces and a back-covering piece that are connected by adjustable straps that run over the shoulders of the user and lacing assemblies that pass around the sides of the user. The chest covering and back covering pieces each have one or more detachable panels mounted on their interior surfaces that include compartments holding built-in ice sheets composed of refrigerant cubes for providing cooling to the user. The panels are releasably attached to the chest-covering pieces and back-covering piece so that the panels and the ice sheets can be quickly removed and replaced when the ice becomes melted. The compartments in the panels include fabric mesh layers along their inside surfaces for holding the replaceable ice sheets in contact with the user for cooling and heating purposes while providing a pleasing visual appearance. The compartments and mesh also allow the ice sheets to be inspected to assess the extent to which the refrigerant cubes remain frozen and to detect any damage to the ice sheets indicating that the ice sheets should be removed from the compartments and replaced.

8 Claims, 7 Drawing Sheets

TEMPERATURE CONTROL VEST HAVING VISIBLE ICE SHEETS COMPOSED OF REFRIGERANT CUBES

BACKGROUND OF THE INVENTION

The present invention relates to garments for use in heating or cooling users who work in extreme temperature environments and more particularly to cooling vests containing ice sheets composed of refrigerant cubes.

Several different types of cooling garments have been developed and used in the past to cool the workers and alleviate heat stress. For example, U.S. Pat. No. 5,146,625 to Steele et al. discloses cooling vest comprising front and back panels having an open side and shoulder construction subject to closure using hook and loop construction fasteners that also serve to provide a non-integral construction which facilitates quick removal of the vest. The panels include pockets for receiving cooling gel packs that may be segmented into pouches. U.S. Pat. No. 4,033,354 to De Rosa describes an ice cooling garment comprising front and rear body panels attached over the shoulders and sides of a user. Matable hook and loop strip fasteners are used to secure sets of pockets containing sealed plastic bags filled with ice to the matching strips attached to the inside of the garment. The pockets may be removed from the garment and replaced when the ice in the bags is melted. U.S. Pat. No. 4,601,067 to Buonassissi discloses a vest structure having front and back panels including pockets in which water tight cool packs or hot packs may be inserted. U.S. Pat. No. 4,856,294 to Scaringe et al describes a micro-climate cooling vest having a chest enclosing portion and back portion featuring a double wall construction including an inner envelope or liner composed of adjacent chambers filled with special heat exchange material that undergoes a phase change from 60-90 degrees F. Ice packets may be sandwiched in between the heat exchange material and the outer layers of the vest to augment its cooling action.

However, these designs no not provide for the quick and convenient removal and replacement of cooling materials. Further, the cooling medium is not configured to provide a pleasing display or allow its ready inspection to determine whether or not it remains frozen and detect if the material has sustained any damage during use.

SUMMARY OF THE INVENTION

The present invention comprises a temperature control vest for use in providing cooling for workers subject to heat stress in high temperature work environments. The temperature control vest of the present invention includes a pair of chest-covering pieces and a back-covering piece. Adjustable shoulder straps connect and support the chest-covering pieces and the back-covering piece over the shoulders of a user and lacing assemblies connect the chest-covering pieces and the back-covering piece around the sides of the user so that the vest fits snuggly around the torso of the user and conforms to the body of the user.

The chest covering and back covering pieces each have one or more detachable panels mounted on their interior surfaces which include built-in replaceable ice sheets composed of refrigerant cubes for providing cooling. The panels are releasably attached to the chest-covering pieces and back-covering piece by sets of hook and loop strips so that the panels can be quickly removed and replaced. Each of the panels has a plurality of compartments including transparent web coverings or fabric mesh layers on their inside surfaces for holding the replaceable ice sheets in position in contact with the user for cooling and heating purposes while allowing the ice sheets to be removed and replaced if they become damaged. The compartments and in particular the mesh allow the ice sheets to be visible to the user through the mesh when the vest is not being worn in order to thereby provide a pleasing appearance and allow the ice sheets to be visibly inspected for damage and to assess whether or not or to what extent they remain in frozen condition.

It is an object of the present invention to provide a temperature control vest that efficiently provides cooling or heating to workers and others in extreme temperature environments using ice sheets having refrigerant cubes mounted along the inside of the vest.

It is another object of the present invention to provide a temperature control vest that has a simple but effective design that allows ice sheets to be mounted in panels that can be quickly attached and detached from the inside of the vest so that the panels including the ice sheets can be quickly replaced with freshly frozen ice sheets when the refrigerant cubes become melted.

It is a further object of the present invention to provide a temperature control vest that has a simple but effective design that allows panels containing multiple ice sheets to be easy inspected and replaced when the ice becomes melted.

It is a further object of the present invention to provide a temperature control vest that has a simple but effective design that allows individual ice sheets to be easy inspected and replaced if they become damaged.

It is yet another object of the present invention to provide a temperature control vest that has a simple but effective design that allows ice sheets to efficiently provide cooling or heating to workers while also providing a pleasing visual appearance.

It is a yet further object of the present invention to provide a temperature control vest that has a simple but effective design that allows the ice vest to be fitted to individual users and to form a compact and safe package around the user.

DETAILED DESCRIPTION

Figure 1:
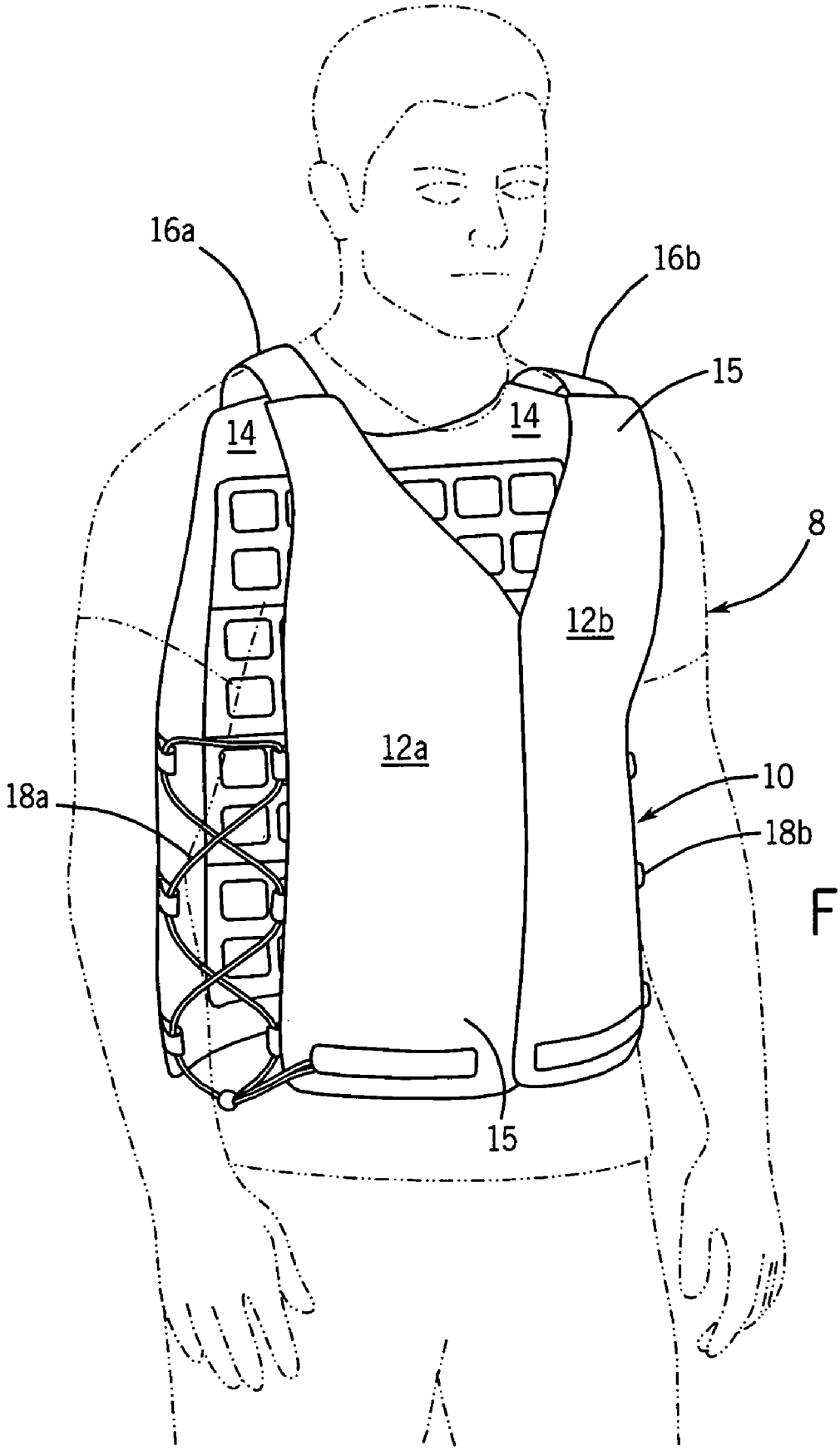
FIG. 1 provides a perspective view of a temperature control vest in accordance with the present invention being worn by a user who is shown in phantom outline.

Referring now to FIG. 1, the temperature control vest 10 comprises a right chest-covering piece 12*a* and a left chest-covering piece 12*b* and a back covering piece 14 that fit around the chest and back of the user 8 (in phantom). The chest and back covering pieces 12*a*, 12*b* and 14 all have a composite construction including an outer layers 15 of fabric such as 200 dernier nylon defining a durable outside shell for the vest 10, thin middle layers of an insulating material such as polyurethane and an interior liner 25 (not shown in FIG. 1) of thin nylon fabric which are all stitched together along seams at their outside edges. The inside of the vest 10 includes ice sheets for temperature control purposes as described in greater detail hereinafter. The chest-covering pieces 12*a* and 12*b* are connected to the back-covering piece by the adjustable shoulder straps 16*a* and 16*b* and the adjustable side fasteners 18*a* and 18*b*. The adjustable shoulder straps 16*a* and 16*b* and the adjustable side fasteners 18*a* and 18*b* allow the temperature control vest 10 to be fitted to the individual user so that the vest is snug around the torso of the user 8 with the chest-covering pieces 12*a* and 12*b* and back-covering piece in close contact with the body of the user.

Figure 2:
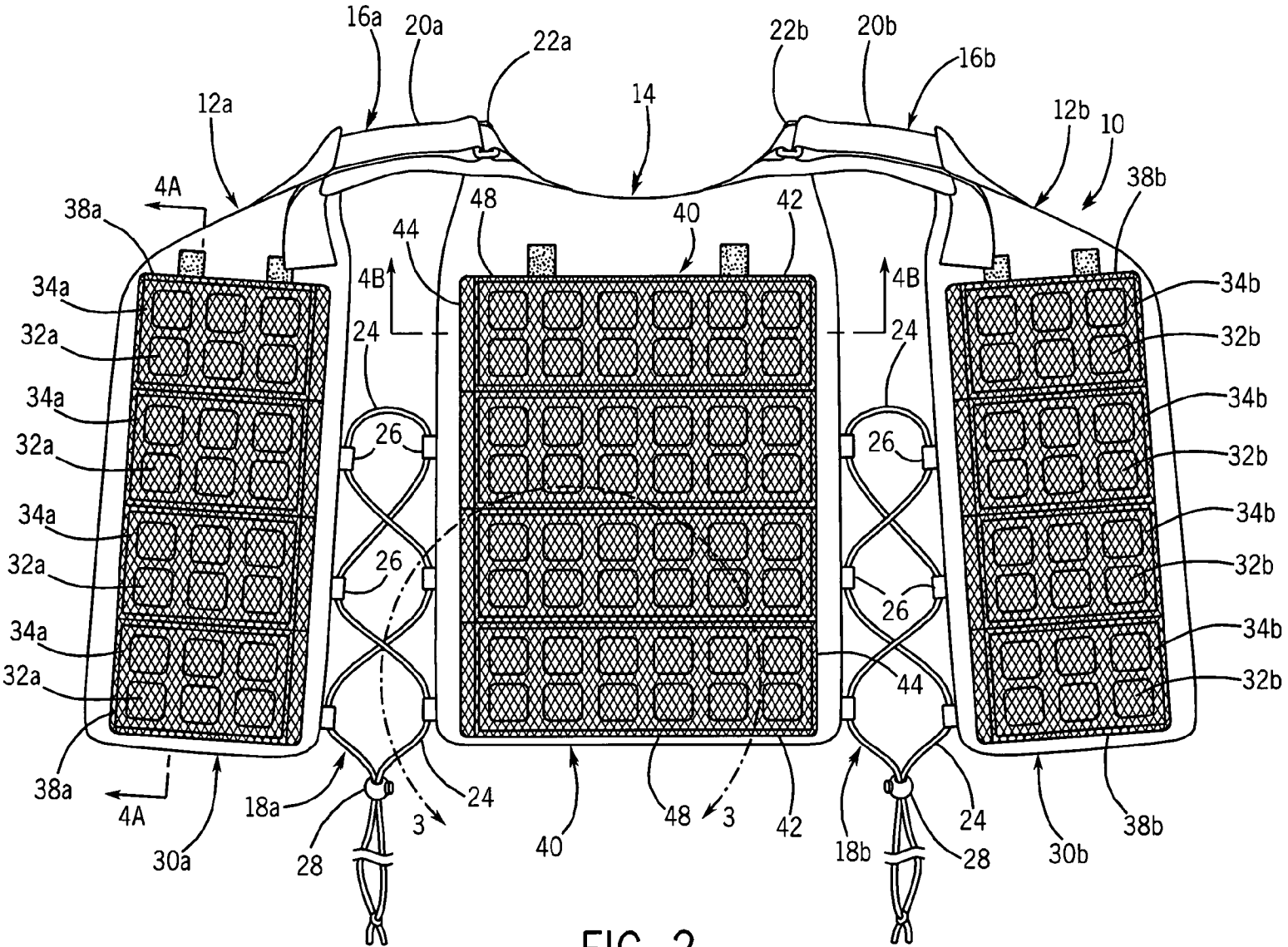
FIG. 2 provides a plan view of the inside of a temperature control vest showing the construction of the vest and showing the ice sheets disposed along its inside surfaces in accordance with the present invention.

Referring now to FIG. 2, the chest-covering pieces 12*a* and 12*b* are connected by the adjustable shoulder straps 16*a* and 16*b* and side fasteners 18*a* and 18*b*. The adjustable shoulder straps comprise wide nylon straps 20*a* and 20*b* attached to the chest-covering pieces and rectangular rings 22*a* and 22*b* attached to the back-covering piece 14 through which the straps 20*a* and 20*b* are threaded. The straps 20*a* and 20*b* are doubled back onto themselves and have hook and loop constructions (such as Velcro™ hook and loop materials) on one side so that that the straps are adjustably secured onto themselves as they are doubled back. The side fasteners 18*a* and 18*b* comprise lacing assemblies having draw strings 24 fitting through retaining tabs 26 attached to the chest-covering pieces 12*a* and 12*b* and back-covering piece 14. The draw strings 24 are adjustably secured by cord barrel locks 28.

The chest-covering pieces 12*a* and 12*b* include detachable panels 30*a* and 30*b* for holding separate replaceable ice sheets 32*a* and 32*b* in separate compartments 34*a* and 34*b*. Each panel 30*a* and 30*b* holds four ice sheets 32*a* and 32*b* in four vertically adjacent compartments 34*a* and 34*b* covered by fabric mesh layers 38*a* and 38*b*. The back-covering piece 14 includes a detachable panel 40 for holding four large separate replaceable ice sheets 42 in separate compartments 44. The panel 40 holds four long ice sheets 42 in four vertically adjacent compartments 44 covered by a fabric mesh layer 48.

Figure 3:
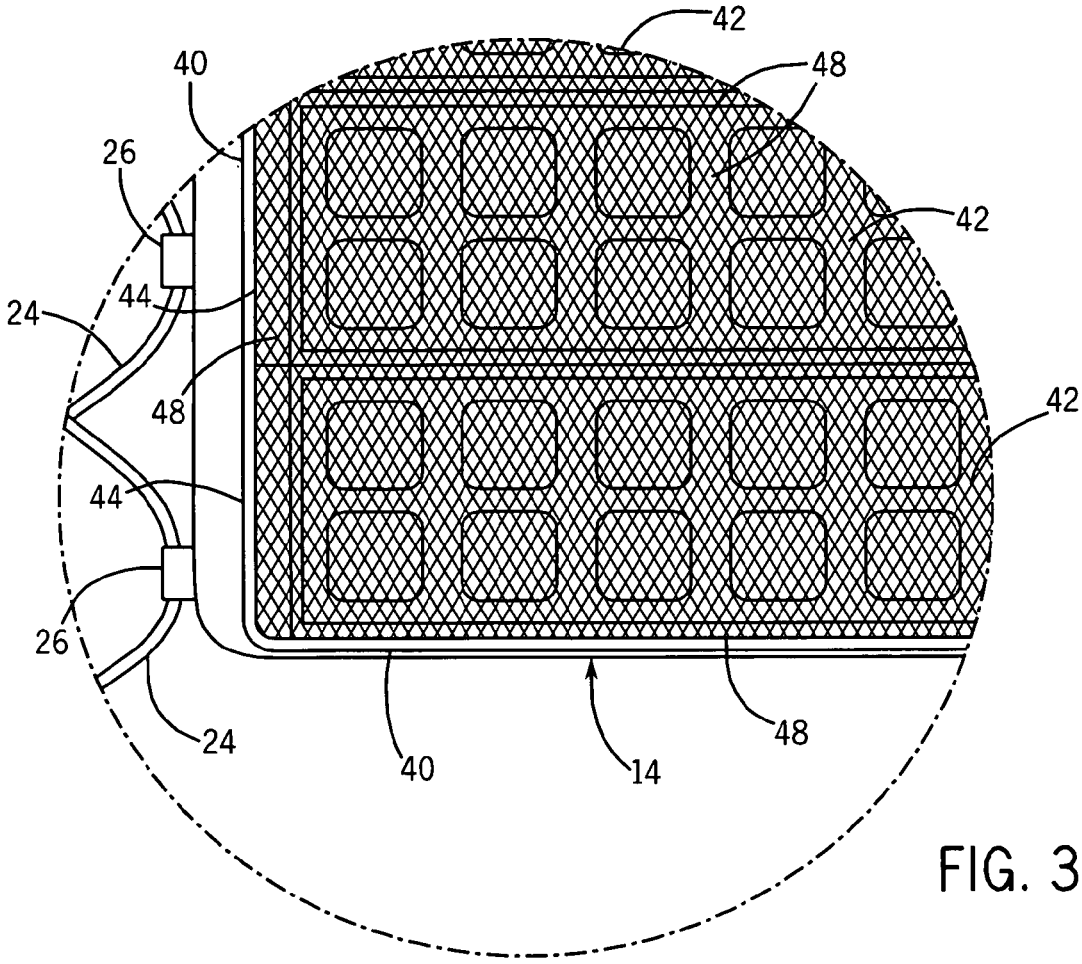
FIG. 3 provides a close-up of one side of the back-covering piece along lines 3-3 of FIG. 2 further illustrating the construction of detachable panels for containing replaceable ice sheets in accordance with the present invention.

Referring now to FIG. 3, the panel 40 of the back-covering piece 14 includes separate ice sheets 42 in separate compartments 44 covered by nylon fabric mesh layer 48. The retaining tabs 26 are attached to one side of the back-covering piece 14 with a drawstring 24 passing through them. The ice sheets 42 are held within the compartments 44 by the mesh 48 while the mesh allows direct contact between the body or inner clothing of the user in order to provide for efficient transfer of heat away from the body area of the user by conduction.

Figure 4A:
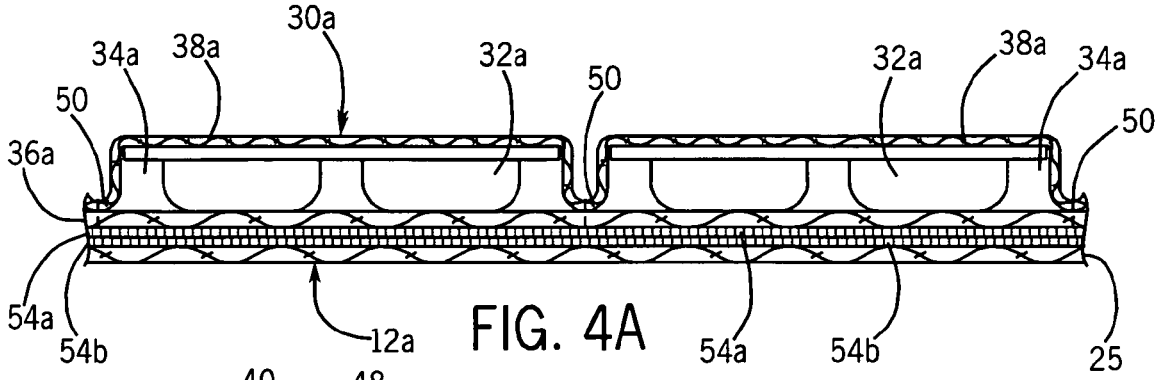
FIG. 4A provides a longitudinal cross-section of one of the back-covering piece along lines 4A-4A of FIG. 2 further illustrating the construction of detachable panels for holding ice sheets and the means of their attachment to the chest and back covering pieces in accordance with the present invention.

Referring now to FIG. 4A, the separate compartments 34*a* are formed by the nylon fabric mesh layer 38*a* which is stitched to the nylon fabric panel backing layer 36*a* at the seams 50 to form a mostly transparent web covering the ice sheets 32*a*. The ice sheets 32*a* are tightly secured within the compartments 34*a* between the backing layer 36*a* and the web or mesh layer 38*a* but can be removed through the closure 90 (see FIG. 4B). The panel 30*a* is removably attached to the chest-covering piece 12*a* by the strips 54*a* and 54*b* which are covered on their opposing faces with hook and loop constructions. The strips 54*a* and 54*b* are attached to the back of the detachable panel 30*a* along the backing layer 36*a* and the inside liner 25 of the chest-covering piece 12*a*, respectively.

Figure 4B:
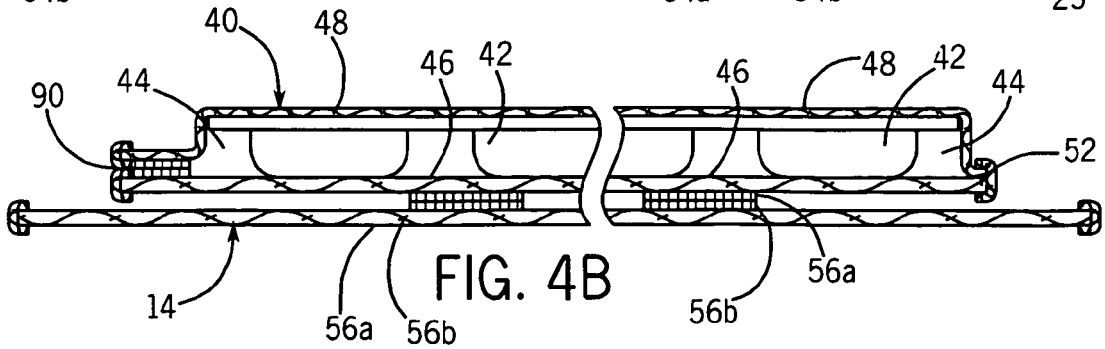
FIG. 4B provides a transverse cross-section of one of the back-covering piece along lines 4B-4B of FIG. 2 further illustrating the construction of detachable panels for holding ice sheets and the means of their attachment to the chest and back covering pieces in accordance with the present invention.

Referring now to FIG. 4B, the compartment 44 is formed by the nylon fabric mesh layer 48 which is stitched to the nylon fabric panel backing layer 46 at the seams 52 to form a mostly transparent web covering the ice sheets 42. The ice sheets 42 are tightly secured within the compartments 44 between the backing layer 46 and the web or mesh layer 48. The panel 40 is removably attached to the back-covering piece 14 by the strips 56*a* and 56*b* which are covered on their opposing faces with hook and loop constructions. The strips 56*a* and 56*b* are attached to the back of the detachable panel 40 along the backing layer 46 and the inside liner 25 of the back-covering piece 14, respectively.

Figure 4C:
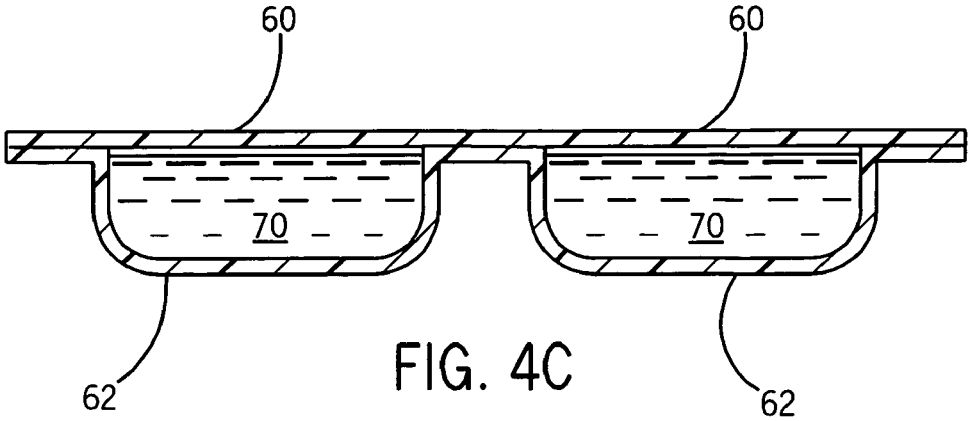
FIG. 4C provides a close-up cross-section of a section of a representative ice sheet in accordance with the present invention.
Figure 5A:
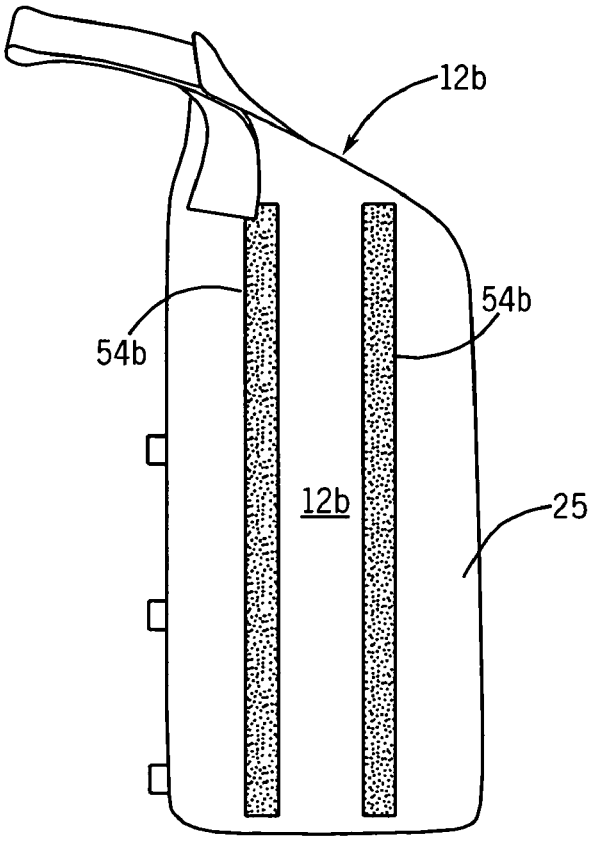
FIGS. 5A-5D provide plan views of the inside of one of the chest-covering pieces, back of a detachable panel (for mating with the chest covering piece), inside of the back-covering piece and back of a detachable panel (for mating with the back-covering piece), respectively.
Figure 5B:
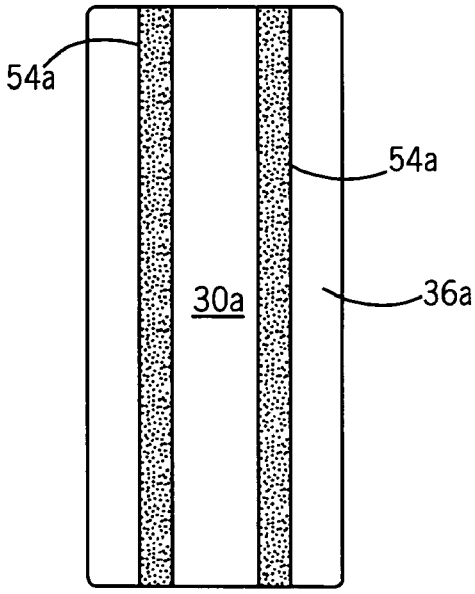
Figure 5C:
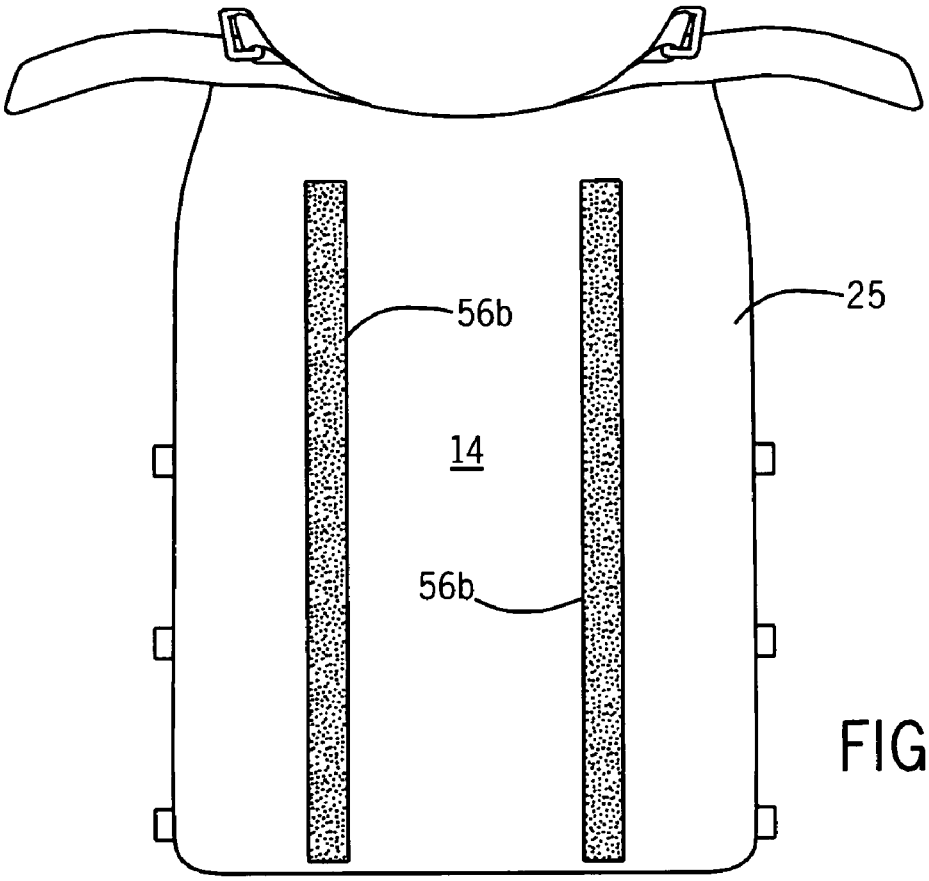
Figure 5D:
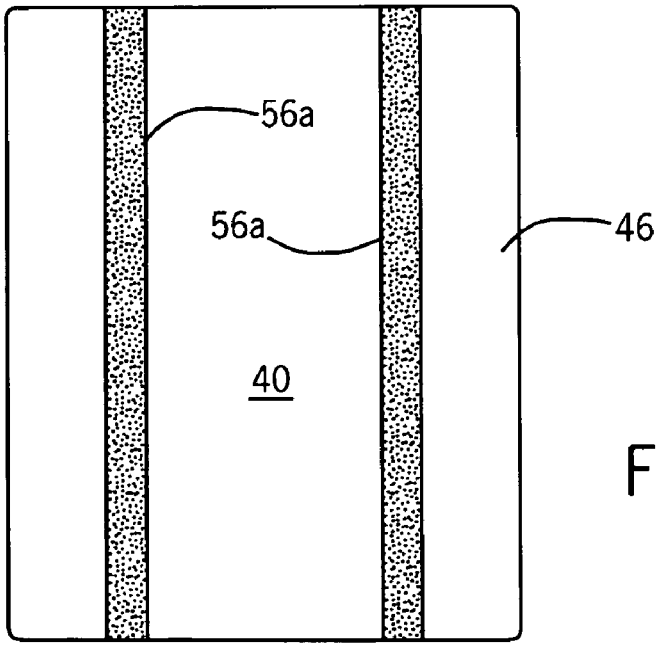

Referring now to FIG. 4C, the ice sheet includes a flat backing layer 60 a molded top layer 62 formed to define sets of ice-cube like shapes and sealed onto the backing layer 60. The refrigerant cubes 70 may be filled with distilled water or and any of number a freezable gels or brine solution if a lower temperature freezing composition is desired. The backing layer 60 and top layer 62 are made of transparent plastic so that the refrigerant cubes and the frozen material are visible from the outside and can be seen through the mesh layers 38*a* and 38*b* and 48 and present a pleasing visual appearance to the user as well as allowing the refrigerant cubes 70 to be visually inspected for melting or damage.

Referring now to FIGS. 5A-5D the strips 54*a*, 54*b*, 56*a* and 56*b* are secured either by adhesive or preferably by stitching to the liner 25 on the inside of one of the chest-covering pieces 12*b*, the back of a detachable panel 30*b*, the liner 25 on the inside of the back-covering piece 14 and the back of a detachable panel 40, respectively. The matching strips 54*a* and 54*b* have hook and loop constructions on their opposing surfaces and are positioned and aligned on the panels 30*a* and 30*b* and pieces 12*a* and 12*b* for mating with and removably attaching the panels 30*a* and 30*b* to the chest-covering pieces 12*a* and 12*b*. The matching strips 56*a* and 56*b* have hook and loop constructions on their opposing surfaces and are positioned and aligned on the panel 40 and piece 14 for mating with and removably attaching the panel 40 to the back-covering piece 14.

Figure 6A:
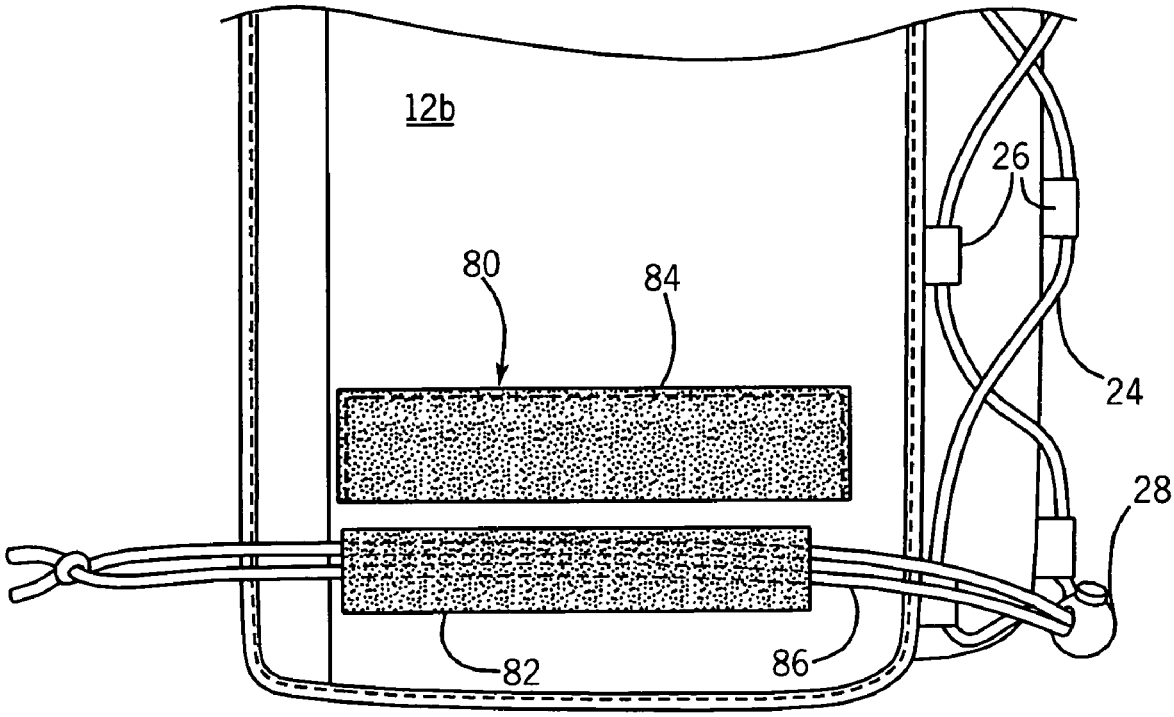
FIG. 6A provides a plan view of the bottom front one of the chest covering pieces showing a fastener for retaining the ends of a draw string in accordance with the present invention.

Referring now to FIG. 6A, the drawstring fastener 80 includes a thin horizontal bottom flap 82 attached at its lower edge to the chest-covering piece 12*b* and a thin horizontal top flap 84 attached at its upper edge to the same chest-covering piece 12*b*. The top flap 84 is designed to overlap with the bottom flap 82 when it is flipped down and both flaps include hook and loop constructions on their opposing surfaces for securing the flaps together. The end portions 86 of the draw string 24 are positioned so as to pass underneath the bottom flap 82. The top flap 84 is flipped up and away from the bottom flap 82 (in FIG. 6A) as would be required to allow the draw string 24 to be placed under the bottom flap 82.

Figure 6B:
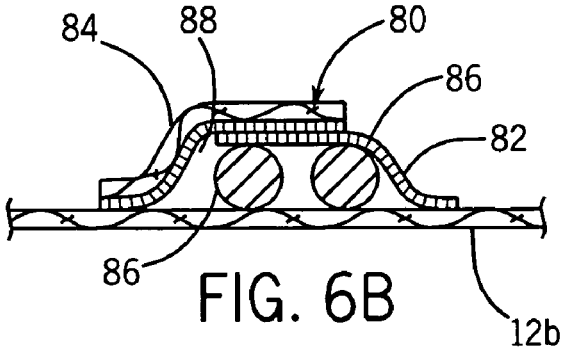
FIG. 6B provides a cross-section of the bottom of the front of the chest-covering piece shown in FIG. 6A further showing a fastener for retaining the ends of a draw string in accordance with the present invention.

Referring now to FIG. 6B, the draw string 24 is safely retained within the fastener 80 attached to the chest-covering piece 12*b* with the top flap 84 flipped down over the bottom flap 82. The top flap 84 is secured to the bottom flap 82 with the drawstring safely trapped out of the way in a pocket 88 formed underneath them.

Figure 7A:
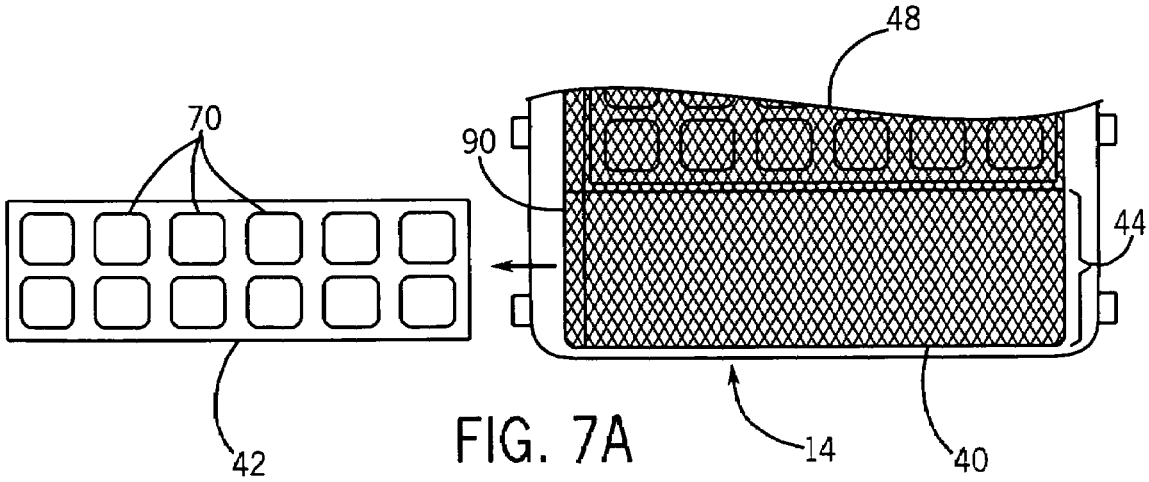
FIGS. 7A-7B provide plan views of a portion of the inside of the back-covering piece and a portion of the inside of one of the chest-covering pieces showing, in each case, one of the replaceable ice sheets removed from its compartment in accordance with the present invention.

Referring now to FIG. 7A, the ice sheet 42 is completely removed from its compartment 44 in the detachable panel 40 with the compartment now being empty and being capable of receiving a new and freshly frozen sheet of refrigerant cubes. The ice sheet 42 can be removed from compartment 44 at the closure 90. The closure 90 is preferably defined by matching thin hook and loop strips attached to the liner 25 and the mesh layer 48 at the far the edge of the compartment. The ice sheet 42 can be seen to be composed of six columns and two rows of vertically and horizontally aligned refrigerant cubes 70.

Figure 7B:
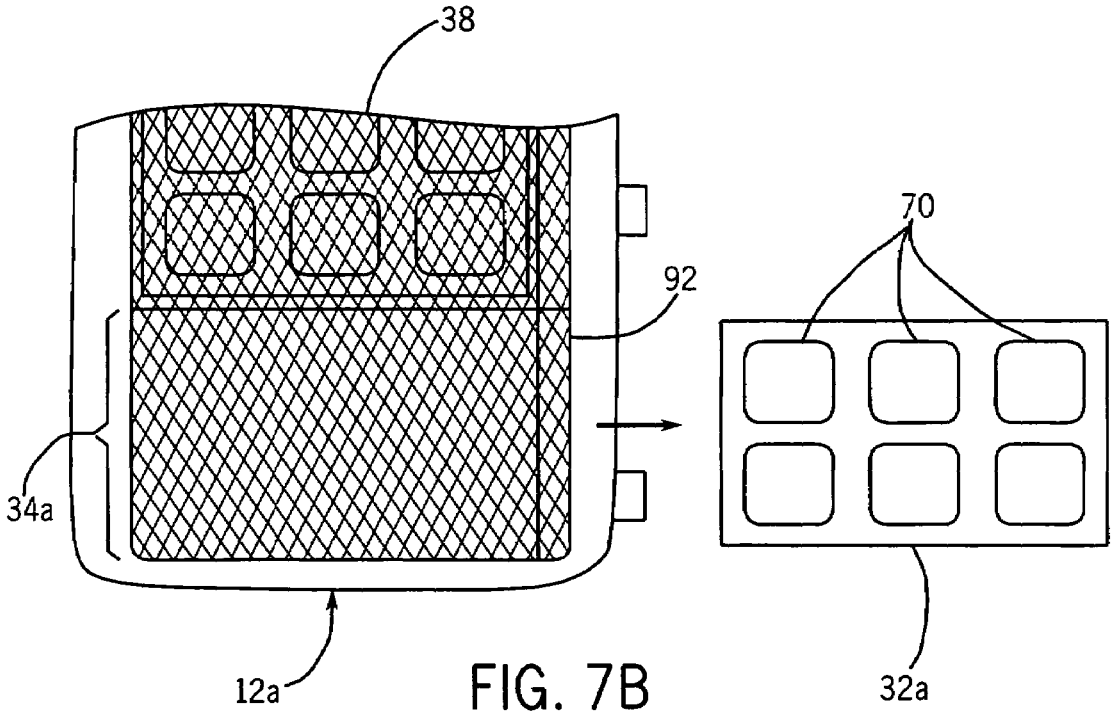

Referring now to FIG. 7B, the ice sheet 32*a* is completely removed from its compartment 34*a* in the detachable panel 30*a* with the compartment now being empty and being capable of receiving a new and freshly frozen sheet of refrigerant cubes. The ice sheet 32*a* can be removed from compartment 34*a* at the closure 92. The closure 92 is preferably defined by matching thin hook and loop strips attached to the liner 25 and the mesh layer 38 at the far the edge of the compartment. The ice sheet 32*a* can be seen to be composed of three columns and two rows of vertically and horizontally aligned refrigerant cubes 70.

The temperature control vest 10 provides an effective tool for helping to keep workers and others in high temperature environments cool and avoid heat stress. The vest 10 may be placed in the freezer compartment of a refrigerator to freeze the refrigerant cubes and taken out when needed with a minimum of effort in preparing the vest 10 for use. The panels 30*a*, 30*b* and 40 including their ice sheets may be conveniently removed from the vest 10 at any time and may be replaced by new panels including freshly frozen refrigerant at any time as required during use. The mesh layers 38*a*, 38*b* and 48 allow the ice sheets in the panels to be visually inspected to ascertain the degree of any melting and determine whether the panels need to be replaced with new panels containing freshly frozen refrigerant cubes. Also, the individual ice sheets 32*a*, 32*b* and 42 may be inspected to detect any damage to them and determine whether or not any of the ice sheets need to be removed from their compartments and permanently replaced.

Although the present invention has been described with reference to the specific embodiments described above, it should be recognized that changes may be made in the form and details of the invention as described without departing from spirit of the invention or the scope of the claims.

The invention claimed is:

1. A temperature control vest apparatus consisting of:

a plurality of refrigerant cube structures, each of said refrigerant cube structures comprised of a flat backing layer and a molded top layer formed into a plurality of individually contained cube shapes filled with fluid and sealed on said backing layer;

a detachable panel assembly comprised only of a right chest-covering panel, a left chest-covering panel, and a back-covering panel, each panel of said detachable panel assembly further comprised of at least one nylon outer layer and at least one inner insulating layer;

a plurality of lacing assemblies, each of said lacing assemblies further comprised of a draw string fitting through at least one retaining tab;

a plurality of adjustable nylon shoulder straps, each of said nylon shoulder straps further including at least one hook and eye assembly and at least one side fastener; and a plurality of refrigerant cube structures receiving panels comprised of a nylon fabric mesh layer and a nylon fabric panel backing layer, each of said plurality of refrigerant cube structures receiving panels adapted to receive a plurality of said refrigerant cube structures, said nylon fabric mesh layer connected to the top surface of said nylon fabric panel backing layer, said nylon fabric panel backing layer further includes at least one back surface which is affixed to at least one detachable panel of said panel assembly.

2. The temperature control vest apparatus of claim 1, wherein: said fluid is selected from a group consisting of water, distilled water, freezable gels, and brine solutions.

3. The temperature control vest apparatus of claim 1, wherein said lacing assembly further includes a barrel cord lock for locking said draw string in position.

4. The temperature control vest apparatus of claim 1, wherein: said chest-covering and back-covering panels further include an outer nylon fabric layer, and inner fabric layer and an insulating layer positioned in between said outer and inner fabric layers.

5. The temperature control vest apparatus of claim 3, wherein: said chest-covering pieces further include fasteners for safely retaining the ends of said draw string.

6. The temperature control vest apparatus of claim 1, wherein said plurality of cube shapes of said refrigerant cube structures are encapsulated in transparent plastic layers and are disposed in rows and columns.

7. The temperature control vest apparatus of claim 1, wherein said plurality of refrigerant cube structures receiving panels further include compartments in said refrigerant cube structures receiving panels and hook and loop closures for releasably holding said refrigerant cube structures in said compartments.

8. The temperature control vest apparatus of claim 7, wherein said compartments have transparent coverings comprised of fabric mesh layers along the inside surfaces of said compartments for use in holding said refrigerant cube structures so that the refrigerant cube structures are visible to the user through the mesh when the vest is not being worn.

* * * * *